United States Patent [19]

Rohleder et al.

[11] Patent Number: 5,062,458

[45] Date of Patent: Nov. 5, 1991

[54] ANNULAR VESSEL FOR RECEIVNG RADIOACTIVE SOLUTIONS CONTAINING SOLIDS

[75] Inventors: Norbert Rohleder, Bruchsal-Obergrombach; Hubert Praxl, Waghäusel; Dietrich Göbel-Rick, Oberramstadt, all of Fed. Rep. of Germany

[73] Assignee: Deutsche Gesellschaft für Wiederaufarbeitung von Kernbrennstoffen mbH, Hannover, Fed. Rep. of Germany

[21] Appl. No.: 501,156

[22] Filed: Mar. 29, 1990

[30] Foreign Application Priority Data

Mar. 30, 1989 [DE] Fed. Rep. of Germany ..... 3910262

[51] Int. Cl.[5] ..... B65B 3/10

[52] U.S. Cl. ..... 141/70; 141/65; 141/91; 141/95; 141/67; 366/106; 366/107; 366/142; 261/77

[58] Field of Search ..... 141/11, 65, 67, 69, 141/70, 85, 89–91, 94, 95, 249; 366/101, 139, 106, 107; 134/102; 137/592; 261/77; 366/142

[56] References Cited

U.S. PATENT DOCUMENTS

| | | | |
|---|---|---|---|
| 1,892,839 | 1/1933 | Howard | 366/142 |
| 2,772,867 | 12/1956 | Cleckner | 261/77 |
| 2,884,230 | 4/1959 | Pyle et al. | 366/106 |
| 3,582,046 | 6/1971 | Mueller et al. | 366/106 |
| 3,789,794 | 2/1974 | Smith et al. | 137/93 X |
| 4,337,152 | 6/1982 | Lynch | 210/197 |
| 4,565,660 | 1/1986 | Hultholm et al. | 366/101 X |
| 4,595,039 | 6/1986 | Tholander | 139/435 |
| 4,844,276 | 7/1989 | Kunze et al. | 220/5 A |
| 4,844,664 | 7/1989 | Turska | 366/107 X |
| 4,897,221 | 1/1990 | Manchak, Jr. | 252/633 |
| 4,934,569 | 6/1990 | Womack, Jr. et al. | 366/106 X |

FOREIGN PATENT DOCUMENTS 2149425 4/1973 Fed. Rep. of Germany .

*Primary Examiner*—Henry J. Recla
*Assistant Examiner*—Casey Jacyna
*Attorney, Agent, or Firm*—Walter Ottesen

[57] ABSTRACT

The invention is directed to an annular vessel for holding radioactive solutions which contain solids. The vessel has an inclined bottom and a discharge at the lowest point of the vessel. A plurality of pulsators charged with air are mounted in the ring-shaped interior of the vessel so as to extend into the solution. The pulsators operate to completely and evenly discharge the undissolved solids out of the vessel with the flow of solution and to prevent sedimentation. At their bottom ends, the pulsators have respective outlet nozzles which are arranged parallelly to the vessel bottom and are directed toward the lowest point thereof.

9 Claims, 5 Drawing Sheets

ANNULAR VESSEL FOR RECEIVNG RADIOACTIVE SOLUTIONS CONTAINING SOLIDS

FIELD OF THE INVENTION

The invention relates to an annular vessel for receiving radioactive solutions containing solids. The vessel has an inclined bottom wall and is provided with a discharge device at its lowest point.

BACKGROUND OF THE INVENTION

In the chemical reprocessing of irradiated nuclear fuels, nuclear fuel is dissolved in boiling nitric acid to obtain a nitric acid solution. It is known to place this nitric acid solution in geometrically critically safe annular vessels before extracting useful materials. The fuel solution however still contains solution residues or undissolved chips from the cutting up of fuel elements and corrosion products which, as solids, tend to form a sediment on the bottom of the annular vessel. When emptying annular vessels, deposits of solids have been found which could not be moved by blowing in agitating air.

U.S. Pat. No. 4,844,276 discloses an annular vessel having an annular space for accommodating the suspension which contains the solids. The bottom of the annular vessel is arranged to extend at an angle of inclination. An outlet opening is provided at the lowest point of the vessel bottom and this outlet opening is connected to a discharge line for emptying the vessel. Usually, the liquid is emptied vertically upwardly from the annular vessel so that the bottom and walls can be made without any break-throughs. An annular spray arrangement having nozzle openings is provided in the upper portion of the annular space. After any emptying of the vessel, the solids are flushed away from the vessel wall by means of this spray arrangement and flushed down to the lowest point at the bottom of the vessel.

When the fuel solution placed in intermediate storage in the annular vessel has to be moved to other processing stations, it is desirable that the undissolved solids should, as completely and uniformly as possible, be moved also to a solids-liquids separating device such as a centrifuge and/or a filter. In order to achieve this quantitative movement, it is necessary that the solids be as thoroughly dispersed as possible in the discharged fuel solution in order to produce an even flow of solids to the downstream separating device.

It would be possible to bring the solids into turbulence in the annular vessel by using an agitating air line of annular configuration which is positioned close to the bottom. Air could be blown in through the annular agitator air line and turbulence created to disturb the solids in the liquid. However, using agitating air for this thorough mixing process would entrain considerable quantities of radioactive aerosols into the vessel exhaust system. Furthermore, the compressed air requirement for the agitating air for mixing is very high. Then there is also the disadvantage that with agitating air for mixing, heavy particles may to a certain extent accumulate in specific zones of the flow. This is attributed to the fact that mixing solids with agitating air is inadequate in the case of heavy coarse particles.

An arrangement which prevents downward movement in radioactive fission product solutions in storage tanks is disclosed in German Patent 2,149,425. A dip pipe is connected to a hydraulically or pneumatically operated piston. A gas column is connected between the piston and the dip pipe end so that a pulsating column of liquid is generated. The end of the dip pipe has a widened portion and, on the bottom of the storage tank, a conical seat lies opposite this widened portion. The container described here is a conventional storage tank and not an annular tank. No vacuum discharge or emptying arrangements are provided. In the event of any transfer from this storage tank, the problems already described hereinabove would be encountered.

SUMMARY OF THE INVENTION

It is an object of the invention to provide an annular vessel of the type referred to above which is configured so that the undissolved solids are completely and uniformly moved with the flow of fuel solution.

The annular vessel arrangement of the invention is for receiving a radioactive solution containing solids and includes: an annular vessel including a base wall inclined downwardly to a bottom location and mutually adjacent side walls extending upwardly from the base wall to define an annular space for receiving the radioactive solution therein; discharge means disposed at the bottom location for discharging the solution from the vessel; a plurality of pulsators arranged in the annular space one next to the other; air supply means for supplying air under pressure to the pulsators; each of the pulsators extending downwardly into the solution and having a lower end; and, a plurality of outlet nozzles mounted on corresponding ones of the lower ends of the pulsators so as to be parallel to the base wall and positioned so as to direct respective flows of the solution toward the bottom location.

The introduction of pulsating air into the pulsators distributed throughout the annular space causes the liquid present in the pulsator to be in part discharged from the outlet nozzles. On the one hand, this ensures thorough mixing of liquid and solid material in the annular vessel and, on the other hand, a flow is simultaneously generated in the annular vessel which is capable of keeping coarse and heavier solids quantitatively in suspension which, in the event of sedimentation, can be agitated again and so directed within the annular vessel that a continuous clog-free discharge of solids can be assured. Because of the orientation of the pulsators, a directed flow is initiated within the annular vessel and so a directed movement of solids to the discharge location is assured.

The pulsator arrangement of the invention generates two oppositely directed flows. The flow fronts collide with each other at the lowest point in the annular vessel. At this point, there will be a localized increase in the concentration of solids. The outlet nozzles of the pulsators in one half of the ring are directed in a counterclockwise direction for discharge while the outlet nozzles of the pulsators in the other half of the ring are directed in a clockwise direction for discharge.

Funnel-shaped guide plates are arranged around the bottom end of the discharge means. Usually, annular vessels are emptied upwardly through a vertical discharge pipe. The guide plates disposed at the location where the two oppositely directed flows collide are so directed against the flows that the flow of liquid is deflected into the discharge plane and sedimenting particles from higher layers of liquids drop to a considerable extent into the discharge zone of the discharge line. This funnel effect of the guide plates assists the uniform discharge of the solids. This funnel effect is used in the pause between pulses. The pulsation pauses are staggered in time and make settlement possible. For this reason, the solids are guided so that they sink down to a location in front of the discharge opening.

According to another feature of the invention, the annular vessel includes a pulsator at the highest point in the vessel bottom with the pulsator having two oppositely directed outlet nozzles. This measure assures that starting from the highest point in the vessel bottom, two oppositely directed pulsating flows are formed in the direction of the lowest point of the vessel bottom where discharge takes place. In this way, dead flow zones are minimized.

In a further advantageous embodiment of the invention, a slot-shaped opening is provided between the two outlet nozzles of the pulsator which is mounted at the highest point of the vessel bottom. This downwardly directed slot-shaped opening provides an additional impact jet component which is directed against the vessel bottom and assures that no dead zone can form under the outlet nozzles.

In a further advantageous embodiment of the invention, the supply of pulsating air to the individual pulsators can be adjusted independently of each other. As a result of this individual adjustment of each pulsator, it is possible to prevent over-blowing of the discharge zone at the collision region.

The pulsator control according to another feature of the invention relieves the stress on the pulsators during the individual pulses by means of a controlled venting valve. The delayed closure of the magnetic valves produces a defined closure during pulsation. It is assured that for example the discharge air line does not open too soon and that the pressure is relieved.

According to another feature of the invention, the magnetic valve in the pulsed air line is driven by an electrical pulse transducer having a pulse length which is controlled by fill level and density. The control of the magnetic valve in the supply air line is carried out as a function of the fill level and the density of the liquid in the annular vessel. With increasing fill level and/or greater density, the opening time of the magnetic valve in the pulsating air line is increased and the pulse duration is increased. Conversely, the pulse duration becomes shorter when the fill lever and/or density drops.

With the invention, an even dispersal of solids in the flow of liquids is achieved when transferring radioactive solutions which contain solids from an annular vessel, and the solids in suspension are transported horizontally to the discharge location and through a region which is close to the bottom. The deposits of solids are effectively prevented. The minimized air requirement for turbulence in the solids reduces the aerosol charge on the waste air system.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
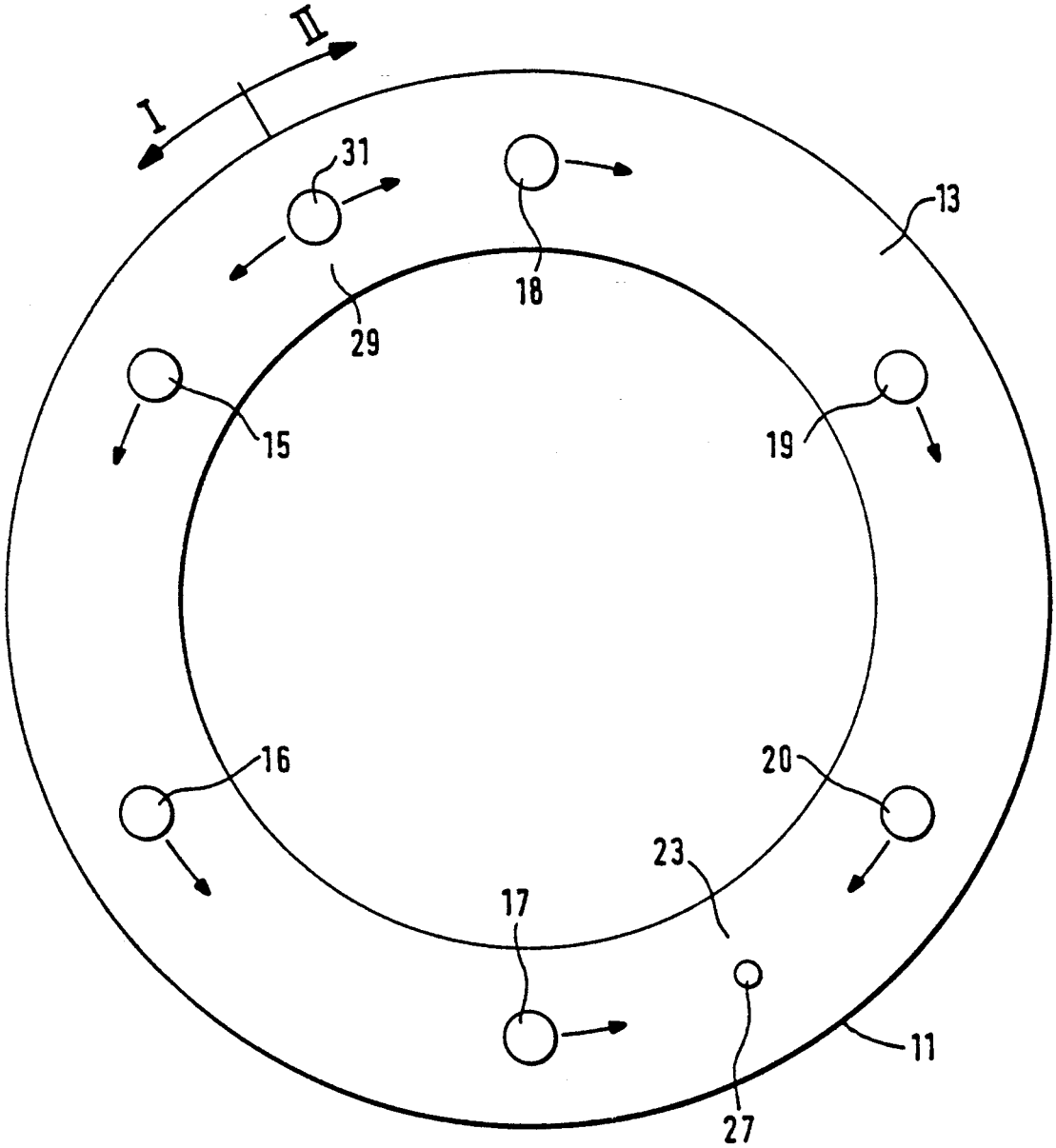
FIG. 1 is a plan view of an annular vessel having a plurality of pulsators distributed throughout the annular space of the vessel.

The annular vessel 11 shown in FIG. 1 includes an annular space 13 which is 40 cm wide. Six pulsators 15 to 20 are disposed in the annular space 13 at an angular spacing of 60 degrees. These six pulsators 15 to 20 are equipped with a unilaterally directed outlet nozzle 21 (FIG. 2) with each nozzle having a venturi nozzle attachment 22. The lowest point 23 of the vessel bottom 25 is located midway between the pulsators 17 and 20. At this center location, a discharge pipe 27 extends vertically upwardly. The highest point 29 of the vessel bottom 25 lies diametrically opposite the location 23. A further pulsator 31 is provided at the highest point 29 which has outlet nozzles (33, 35) directed to both sides (FIG. 2).

Referring to FIG. 1, three pulsators (15, 16, 17) are directed counter-clockwise (arrow I) toward the lowest point 23 while three pulsators (18, 19, 20) are directed clockwise (arrow II) toward the lowest point 23.

Figure 2:
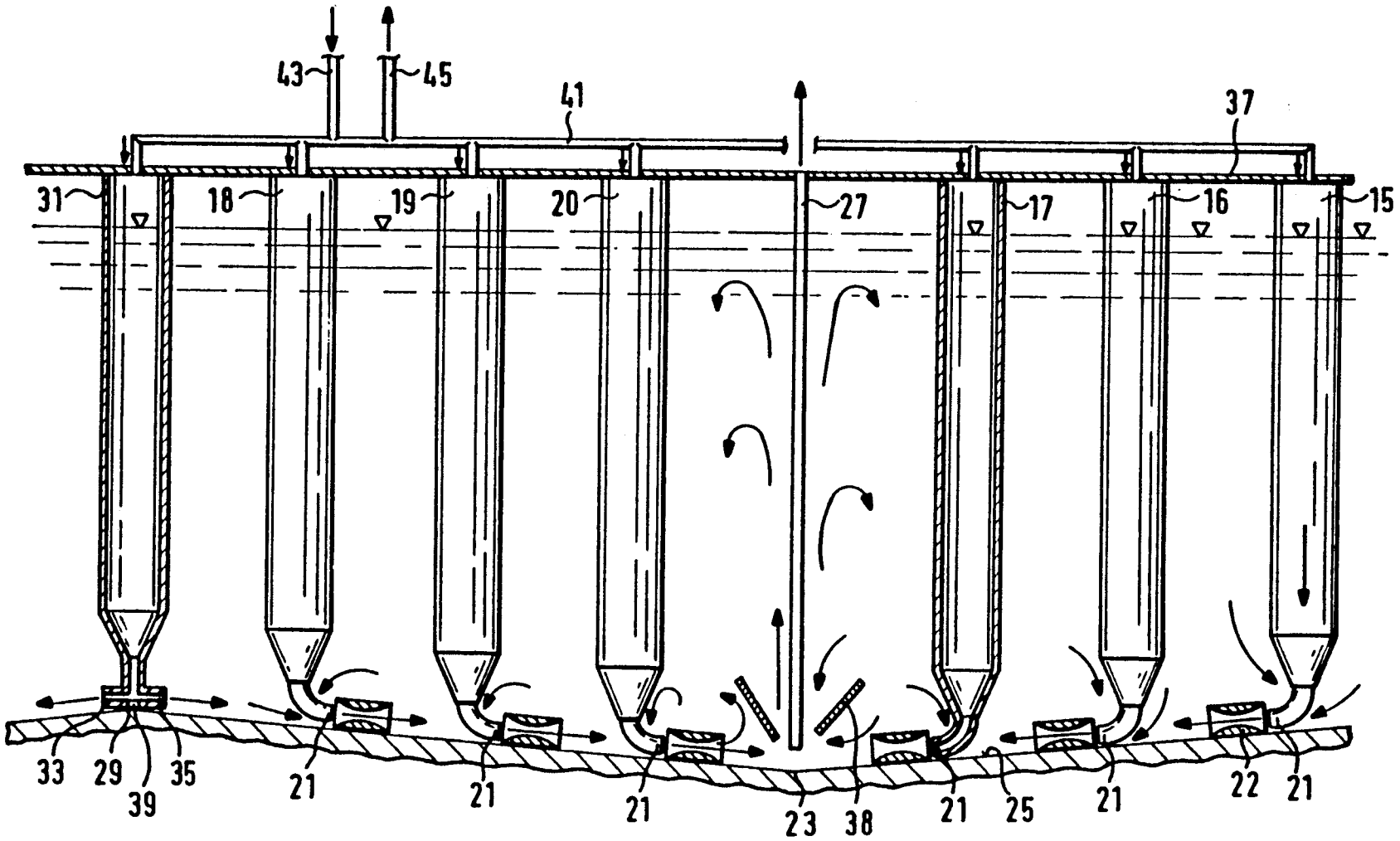
FIG. 2 is an expanded view of the annular vessel of FIG. 1 showing the pulsators connected to a pulsating air source and a vent.

In the expanded view of annular vessel 11 in FIG. 2, it can be seen that the pulsators generate two oppositely directed flows close to the bottom. The six pulsators 15 to 20 have respective outlet nozzles 21 at their bottom ends which are arranged parallelly to the vessel bottom 25. The outlet nozzles 21 of the pulsators 15 to 20 are directed toward the lowest point 23 of the vessel bottom 25. The outlet nozzles 21 of the pulsators 15 to 20 are directed toward the lowest point 23 of the vessel bottom 25 into which the discharge pipe 27 projects from above through a vessel cover 37.

Funnel-shaped guide plates 38 are disposed around the bottom end of the discharge pipe 27. The obliquely positioned guide plates 38 are so directed against the flows close to the bottom that the liquid stream is directed to the opening in the discharge pipe 27. The particles of solid matter which are subjected to turbulence by the pulsation fall downwardly in the pause between pulsations and are to a substantial extent passed in front of the opening of the discharge pipe 27 because of the funnel-shaped configuration of the guide plates 38.

The pulsator 31 disposed at the highest point 29 has two oppositely directed flat jet nozzles 33 and 35. In addition, there is a slot 39 at the bottom end through which an impact jet is directed against the bottom 25 of the vessel. The outlet nozzles (21, 33, 35) are arranged at approximately 1 cm from the bottom.

The pulsators extend into the vessel liquid and are thus filled with a column of liquid. At their upper ends, the pulsators are connected via a pipe 41 to a pulsed air line 43 which is subject to the action of a compressed air source and connected to a vent air line 45.

With the pulsator arrangement described, two oppositely directed flows are generated close to the bottom. At the lowest point 23 of the vessel, the flow fronts collide. In this so-called collision point, localized increases in concentration of solids result which can be discharged with optimum efficiency with the assistance of the guide plates 38.

Figure 3:
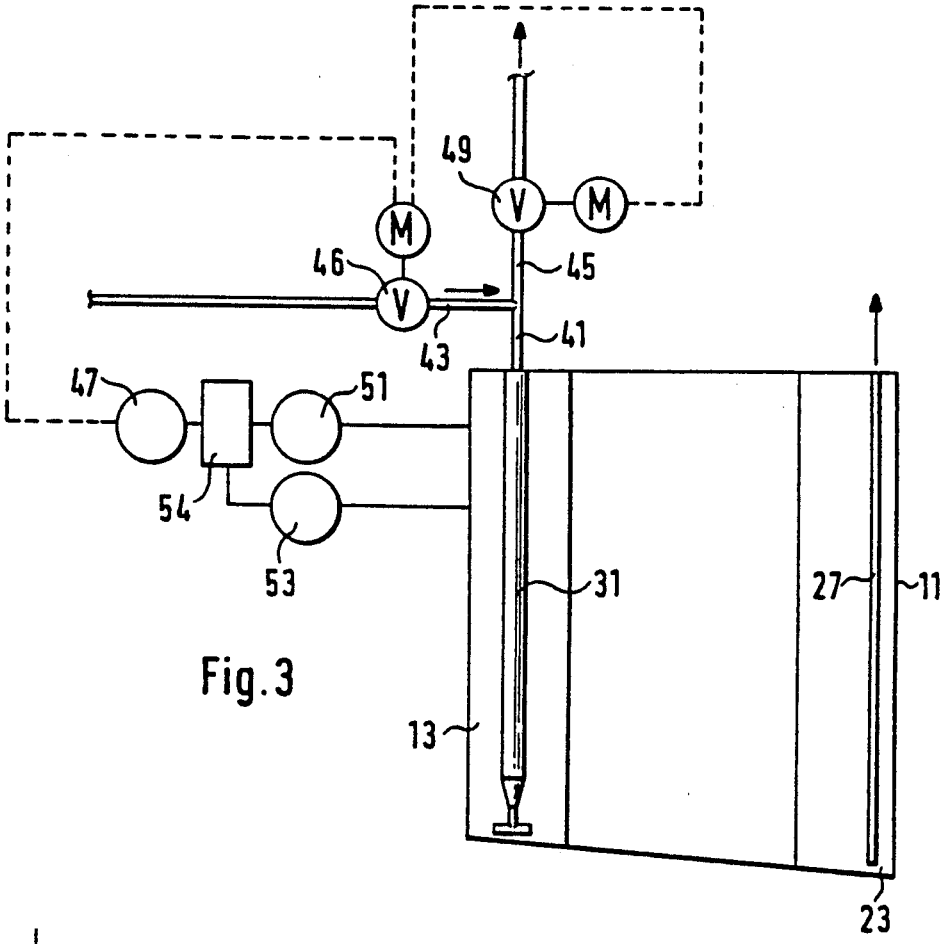
FIG. 3 shows the pulsators in the annular vessel connected to a control circuit for controlling the compressed air pulsation.

For pulsator control (FIG. 3), the pipe 41 of the pulsators, of which FIG. 3 only shows the pulsator 31, is connected to the pulsating air line 43 in which there is a magnetic valve 46. This magnetic valve 46 is driven electrically by a pulse generator 47. A magnetic valve 49 is also provided in vent air line 45. For actuation, the magnetic valve 49 receives push-pull signals from the magnetic valve 46 of the pulsating air system and so opens and closes in opposition thereto. Reference numeral 51 identifies a level gauge while reference numeral 53 denotes a density gauge and both gauges are electrically coupled with the pulse generator 47 via a computer 54.

Figure 4:
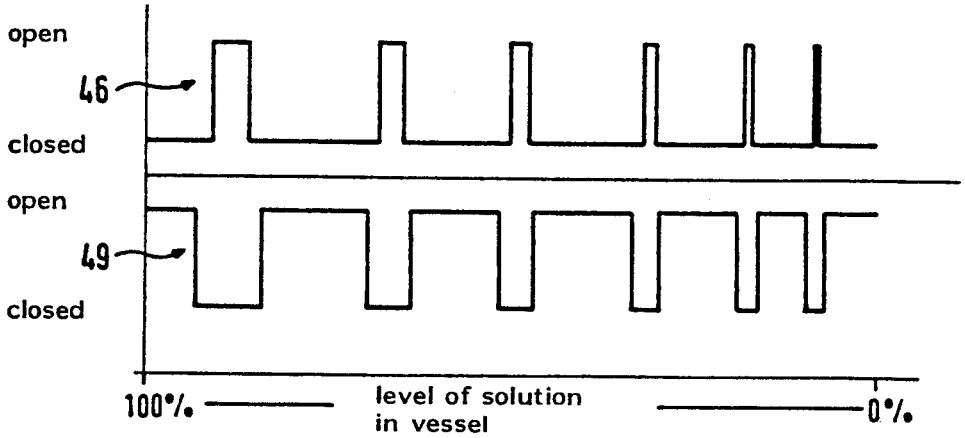
FIG. 4 shows the waveforms for pulsating air and venting air control.

As shown in the waveforms of FIG. 4 and the diagram of the magnetic valve control arrangement in FIG. 3, it is advantageous to control the pulsation as a function of the level of the contents of the vessel. The lower the level, the shorter are the pulses and the pauses between pulses. The magnetic valve 46 opens with a time lag to close the other magnetic valve 49 and vice-versa.

The closure times of the pulsating valve are determined by the time required for the liquid to flow back into the pulsators. This flow-back time is, in turn, primarily dependent upon the following: the clear cross section of the outlet nozzle, the clear cross section of the vent line and the differential pressure. By means of pressure equalization, the magnetic valve 49 in the vent air line 45 provides for the fastest possible return within the closure time of the pulsating valve 46.

Figure 5:
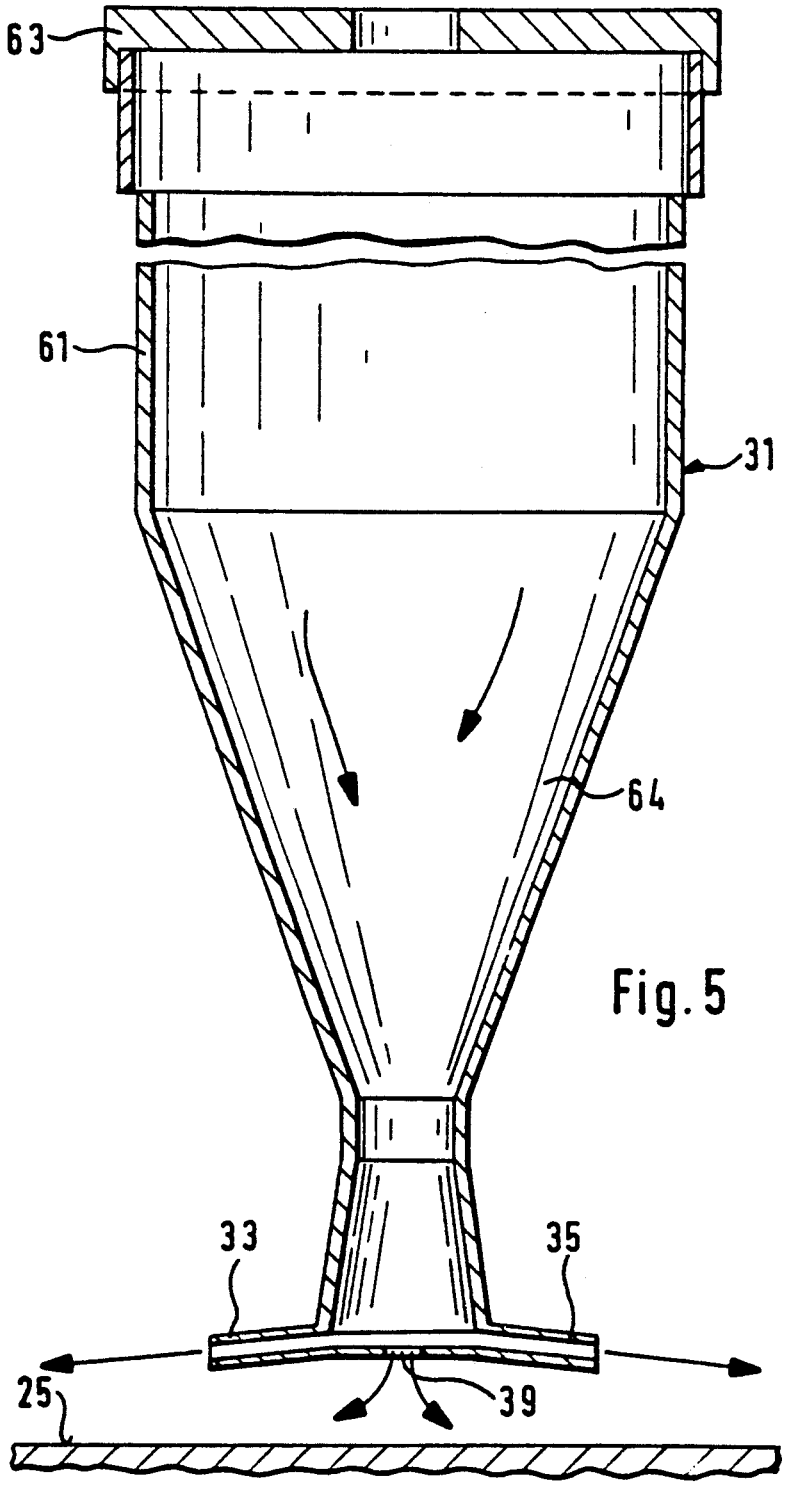
FIG. 5 is an embodiment of a pulsator having two outlet nozzles and disposed in the highest region of the vessel bottom; and, FIG. 6 shows an embodiment of an outlet nozzle for a pulsator.

FIG. 5 shows the pulsator 31 arranged at the highest point 29 in the bottom 25 of the vessel. The pulsator 31 has two outlet nozzles 33 and 35 which are each configured as a slot orientated parallelly to the vessel bottom 25. A slot-like opening 39 is disposed symmetrically between these two outlet nozzles (33, 35) and is directed downwardly. The pulsator pipe 61 ends at the top in a pipe flange 63 for mounting of the pulsator 31. At the bottom, a narrowed portion 64 of the pulsator pipe leads to the outlet nozzles (33, 35).

Figure 6:
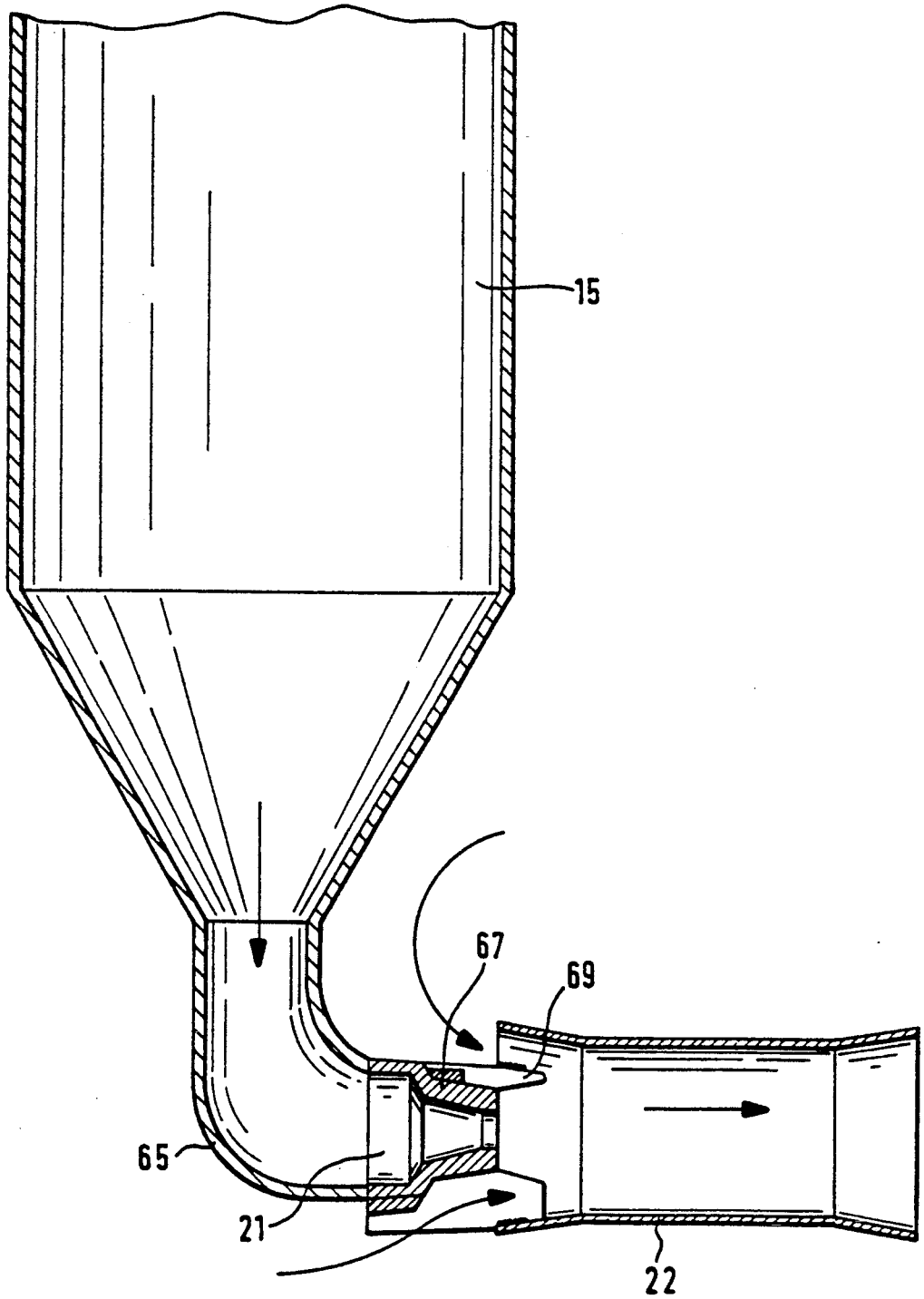

FIG. 6 shows an embodiment of the outlet nozzle for the six pulsators 15 to 20 which are equipped with a unilaterally directed outlet nozzle 21. The outlet nozzle 21 is mounted on the end of a bend 65 disposed on the pulsator 15 and is parallel to the vessel bottom 25. The venturi attachment 22 is mounted on the nozzle body 67 by web-like supports 69. As a result of this venturi attachment 22, any liquid present in the region of the attachment is entrained into the nozzle flow.

The annular vessel having a pulsating arrangement as described above imparts turbulence to solutions which contain solids and which are present in the annular vessel in a layer of about 100 mm above the bottom of the vessel while at the same time transporting the solutions to the discharge means arranged at the lowest point 23 of the vessel bottom.

It is understood that the foregoing description is that of the preferred embodiments of the invention and that various changes and modifications may be made thereto without departing from the spirit and scope of the invention as defined in the appended claims.

What is claimed is:

1. An annular vessel arrangement for receiving a radioactive solution containing solids, the annular vessel arrangement comprising:

an annular vessel including a base wall inclined downwardly to a bottom location and mutually adjacent inner and outer side walls extending upwardly from said base wall to define an annular space therebetween for receiving the radioactive solution therein;

discharge means disposed at said bottom location for discharging the solution from said vessel;

a plurality of pulsators arranged in said annular space one next to the other for receiving respective portions of the radioactive solution therein;

air supply means for supplying air under pressure to said pulsators for acting on said portions of radioactive solution;

each of said pulsators extending downwardly into the solution and having a lower end; and, a plurality of outlet nozzles mounted on corresponding ones of the lower ends of said pulsators so as to be substantially parallel to said base wall and positioned so as to direct respective flows of the solution along said base wall toward said bottom location thereby preventing the solids from accumulating on said base wall.

2. The annular vessel arrangement of claim 1, said air supply means including control means operatively connected to said pulsators for adjusting the supply of air to said pulsators independently of each other.

3. The annular vessel arrangement of claim 1, said air supply means including an air supply line connected to said pulsators for supplying air thereto and a vent line also connected to said pulsators; first and second magnetic valves connected into respective ones of said lines for opening and closing said lines; and, control means for driving said valves so as to cause one of said valves to open while the other one of said valves is closed.

4. The annular vessel arrangement of claim 3, said control means including means for driving said magnetic valves in time-delayed push-pull operation.

5. An annular vessel arrangement for receiving a radioactive solution containing solids, the annular vessel arrangement comprising:

an annular vessel including a base wall inclined downwardly to a bottom location and mutually adjacent side walls extending upwardly from said base wall to define an annular space for receiving the radioactive solution therein;

discharge means disposed at said bottom location for discharging the solution from said vessel;

a plurality of pulsators arranged in said annular space one next to the other;

air supply means for supplying air under pressure to said pulsators;

each of said pulsators extending downwardly into the solution and having a lower end;

a plurality of outlet nozzles mounted on corresponding ones of the lower ends of said pulsators so as to be parallel to said base wall and positioned so as to direct respective flows of the solution toward said bottom location; and, said discharge means including: a vertically extending suction tube for drawing the solution from said vessel, said suction tube being disposed above said bottom location and having a lower end; and, funnel-shaped guide plates disposed in surrounding relationship to said lower end for deflecting said flows.

6. An annular vessel arrangement for receiving a radioactive solution containing solids, the annular vessel arrangement comprising:

an annular vessel including a base wall inclined downwardly to a bottom location and mutually adjacent side walls extending upwardly from said base wall to define an annular space for receiving the radioactive solution therein;

discharge means disposed at said bottom location for discharging the solution from said vessel;

a plurality of pulsators arranged in said annular space one next to the other;

air supply means for supplying air under pressure to said pulsators;

each of said pulsators extending downwardly into the solution and having a lower end;

a plurality of outlet nozzles mounted on corresponding ones of the lower ends of said pulsators so as to be parallel to said base wall and positioned so as to direct respective flows of the solution toward said bottom location; and, said bottom location being the lowest bottom location in said vessel and said vessel having a highest bottom location;

an additional pulsator disposed above said highest point and having a lower end directly above said highest location; and, two outlet nozzles mounted on said lower end of said additional pulsator so as to direct flows of the solution in mutually opposite directions.

7. The annular vessel arrangement of claim 6, said lower end of said additional pulsator having a slot-like opening formed in said lower end so as to be disposed between said two outlet nozzles mounted on said additional pulsator.

8. An annular vessel arrangement for receiving a radioactive solution containing solids, the annular vessel arrangement comprising:

an annular vessel including a base wall inclined downwardly to a bottom location and mutually adjacent side walls extending upwardly from said base wall to define an annular space for receiving the radioactive solution therein;

discharge means disposed at said bottom location for discharging the solution from said vessel;

a plurality of pulsators arranged in said annular space one next to the other;

air supply means for supplying air under pressure to said pulsators;

each of said pulsators extending downwardly into the solution and having a lower end;

a plurality of outlet nozzles mounted on corresponding ones of the lower ends of said pulsators so as to be parallel to said base wall and positioned so as to direct respective flows of the solution toward said bottom location;

said air supply means including an air supply line connected to said pulsators for supplying air thereto and a vent line also connected to said pulsators; first and second magnetic valves connected into respective ones of said lines for opening and closing said lines; and, control means for driving said valves so as to cause one of said valves to open while the other one of said valves is closed;

said control means including means for driving said magnetic valves in time-delayed push-pull operation; and, said control means further including: first sensor means for detecting the level of the solution in said vessel; second sensor means for detecting the density of the solution in said vessel; and, an electrical pulse generator connected to said first and second sensor means for driving said first magnetic valve with pulses having a pulse length dependent upon said level and said density.

9. An annular vessel arrangement for receiving a radioactive solution containing solids, the annular vessel arrangement comprising:

an annular vessel including a base wall inclined downwardly to a bottom location and mutually adjacent side walls extending upwardly from said base wall to define an annular space for receiving the radioactive solution therein;

discharge means disposed at said bottom location for discharging the solution from said vessel;

a plurality of pulsators arranged in said annular space one next to the other;

air supply means for supplying air under pressure to said pulsators;

each of said pulsators extending downwardly into the solution and having a lower end;

a plurality of outlet nozzles mounted on corresponding ones of the lower ends of said pulsators so as to be parallel to said base wall and positioned so as to direct respective flows of the solution toward said bottom location;

said air supply means including an air supply line connected to said pulsators for supplying air thereto and a vent line also connected to said pulsators; first and second magnetic valves connected into respective ones of said lines for opening and closing said lines; and, control means for driving said valves so as to cause one of said valves to open while the other one of said valves is closed; and, said control means including: first sensor means for detecting the level of the solution in said vessel; second sensor means for detecting the density of the solution in said vessel; and, an electrical pulse generator connected to said first and second sensor means for driving said first magnetic valve with pulses having a pulse length dependent upon said level and said density.

* * * * *

UNITED STATES PATENT AND TRADEMARK OFFICE

CERTIFICATE OF CORRECTION

PATENT NO. : 5,062,458

DATED : November 5, 1991

INVENTOR(S) : Norbert Rohleder, Hubert Praxl and Dietrich Göbel-Rick

It is certified that error appears in the above-identified patent and that said Letters Patent is hereby corrected as shown below:

In column 3, line 46: delete "lever" and substitute -- level -- therefor.

Signed and Sealed this

Twentieth Day of April, 1993

*Attest:*

*Attesting Officer*

MICHAEL K. KIRK

*Acting Commissioner of Patents and Trademarks*